US010222088B2

(12) United States Patent
Whitehead

(10) Patent No.: US 10,222,088 B2
(45) Date of Patent: Mar. 5, 2019

(54) ADAPTIVE EXHAUST VENT

(71) Applicant: IPS Corporation, Collierville, TN (US)

(72) Inventor: James H. Whitehead, Collierville, TN (US)

(73) Assignee: IPS CORPORATION, Collierville, TN (US)

( * ) Notice: Subject to any disclaimer, the term of this patent is extended or adjusted under 35 U.S.C. 154(b) by 64 days.

(21) Appl. No.: 15/421,727

(22) Filed: Feb. 1, 2017

(65) Prior Publication Data

US 2018/0216845 A1 Aug. 2, 2018

(51) Int. Cl.

| | |
|---|---|
| ***F24F 7/02*** | (2006.01) |
| ***F24F 13/10*** | (2006.01) |
| *F24F 7/00* | (2006.01) |

(52) U.S. Cl.

CPC ..... *F24F 13/10* (2013.01); *F24F 7/02* (2013.01); *F24F 2007/001* (2013.01)

(58) Field of Classification Search

CPC ..... F24F 7/02; E04D 13/174
USPC ..... 454/365–368; 52/198–199; 138/114
See application file for complete search history.

(56) References Cited

U.S. PATENT DOCUMENTS

| | | | | |
|---|---|---|---|---|
| 2,741,972 A | | 4/1956 | Pryne | |
| 3,472,150 A | | 10/1969 | Strawsine | |
| 3,785,271 A | | 1/1974 | Joy | |
| 3,955,848 A | * | 5/1976 | Lutz | B60J 7/1642 16/268 |
| 5,662,522 A | * | 9/1997 | Waltz | E04D 13/17 454/359 |
| 5,791,985 A | * | 8/1998 | Schiedegger | F24F 7/02 454/339 |
| 6,149,516 A | | 11/2000 | Mantyla | |
| 6,293,862 B1 | | 9/2001 | Jafine et al. | |
| 6,994,622 B2 | | 2/2006 | Koessler | |
| 8,205,401 B2 | * | 6/2012 | Ward | F24F 7/02 454/367 |
| 9,080,779 B1 | | 7/2015 | Leonard | |

(Continued)

OTHER PUBLICATIONS

"Primex HVAC Venting Product Specification Sheet" [retrieved Feb. 28, 2017]. Retrieved from the Internet: <URL: http://www.primexfits.com/hvacventing/wp-content/uploads/2014/01/Spec_Sheet_RV20.pdf>. (dated Sep. 2016) 2 pages.

*Primary Examiner* — Steven B McAllister
*Assistant Examiner* — Ko-Wei Lin
(74) *Attorney, Agent, or Firm* — Womble Bond Dickinson (US) LLP

(57) ABSTRACT

Provided is an exhaust vent for venting air including a base member configured to be secured to a structure. The base member may define an opening in fluid communication with an exhaust conduit of the structure and a raised flange disposed around the opening. The exhaust vent may also include a removable vent adapter, wherein the adapter is configured to connect to the raised flange and maintain fluid communication between the opening and the exhaust conduit. A substantially hollow housing may be attached to the base member and configured to cover the opening of the base member and maintain fluid communication between the opening and an exterior of the housing. A pivoting damper may also be disposed within the substantially hollow housing configured to rest atop the opening of the base member when in a closed position.

20 Claims, 10 Drawing Sheets

(56) References Cited

U.S. PATENT DOCUMENTS

| | | | | |
|---|---|---|---|---|
| 2013/0082459 | A1* | 4/2013 | Kaneko | F16L 37/088<br>285/93 |
| 2013/0333784 | A1* | 12/2013 | Marak | F16K 37/0016<br>137/601.17 |
| 2015/0198343 | A1 | 7/2015 | Huber | |
| 2016/0003390 | A1* | 1/2016 | Harnetiaux | A01C 7/082<br>285/305 |

* cited by examiner

ADAPTIVE EXHAUST VENT

BACKGROUND OF THE INVENTION

Exhaust vents and associated systems allow for air to be vented or otherwise escape from enclosed spaces, such as from the interior of a structure. Additionally, exhaust vents, often used in conjunction with kitchens and bathrooms, may attempt to shield debris from entering a structure to ensure that air is allowed to vent without obstruction. However, conventional exhaust vents may fail to effectively shield conduits installed in a structure from obstruction, and may not be usable in various structures or with varying conduit sizes.

Applicant has identified a number of additional deficiencies and problems associated with conventional exhaust vents and associated systems and methods. Through applied effort, ingenuity, and innovation, many of these identified problems have been solved by developing solutions that are included in embodiments of the present invention, many examples of which are described in detail herein.

BRIEF SUMMARY OF THE INVENTION

Accordingly, embodiments of an adaptive exhaust vent are described in which a base member, a removable vent adapter, a substantially hollow housing, and a pivoting damper are provided. In some embodiments, an exhaust vent comprising a base member may be configured to be secured to a structure, where the base member defines an opening, wherein the opening may be in fluid communication with an exhaust conduit of the structure, and a raised flange may be disposed around the opening. The adaptive exhaust vent may further comprise a removable vent adapter, wherein the adapter may be configured to connect to the raised flange and maintain fluid communication between the opening and the exhaust conduit. The adaptive exhaust vent may comprise a substantially hollow housing attached to the base member, the housing configured to cover the opening of the base member, and maintain fluid communication between the opening and an exterior of the housing. A pivoting damper may be disposed within the substantially hollow housing, wherein the damper may be configured to rest atop the opening of the base member when in a closed position.

In some embodiments, the removable vent adapter may comprise two or more separable components.

In some embodiments, the pivoting damper may be pivotally connected to a side of the housing opposite the opening. In some alternate embodiments, the pivoting damper may further define a counterbalance configured to counterbalance the pivoting damper between open and closed positions.

In some embodiments, the pivoting damper may further define a rim configured to, in a closed position, encircle the raised flange of the base member.

In some embodiments, the substantially hollow housing may further define an exterior opening. In such a case, in some further embodiments, the substantially hollow housing may further define a grate configured to cover the exterior opening.

In some still further embodiments, the substantially hollow housing may further define a first height associated with a side of the housing defining the exterior opening, and a second height associated with a side opposite the exterior opening, wherein the first height may be larger than the second height to promote fluid flow in a defined direction.

In some embodiments, the raised flange may further define one or more recesses configured to receive the removable vent adapter. In some embodiments, the removable vent adapter may further define one or more deflectable tabs configured to engage the one or more recesses of the raised flange.

In some embodiments, the removable vent adapter may further define a sealing element configured to substantially seal the exhaust conduit of the structure.

In some further embodiments, wherein the removable vent adapter comprises two separable components, the separable components may be tiered such that a first separable component has a larger outer diameter than a second separable component.

In some embodiments, the removable vent adapter may further comprise a third separable component. In such an embodiment, the separable components may be tiered such that the second separable component has a larger outer diameter than the third separable component.

In some embodiments, the first separable component may be connected to the raised flange. In some embodiments, the exhaust conduit may be connected to the second separable component. In some still further embodiments, the exhaust conduit may be connected to the third separable component.

In some embodiments, the separable components may connect to one another via a bayonet-type connection.

In some embodiments, the first component and the second component may each further comprise a sealing element configured to substantially seal the exhaust conduit of the structure. In some embodiments, each of the first separable component, the second separable component, and third separable component may further comprise a sealing element configured to substantially seal the exhaust conduit of the structure.

BRIEF DESCRIPTION OF THE SEVERAL VIEWS OF THE DRAWINGS

Figure 1:
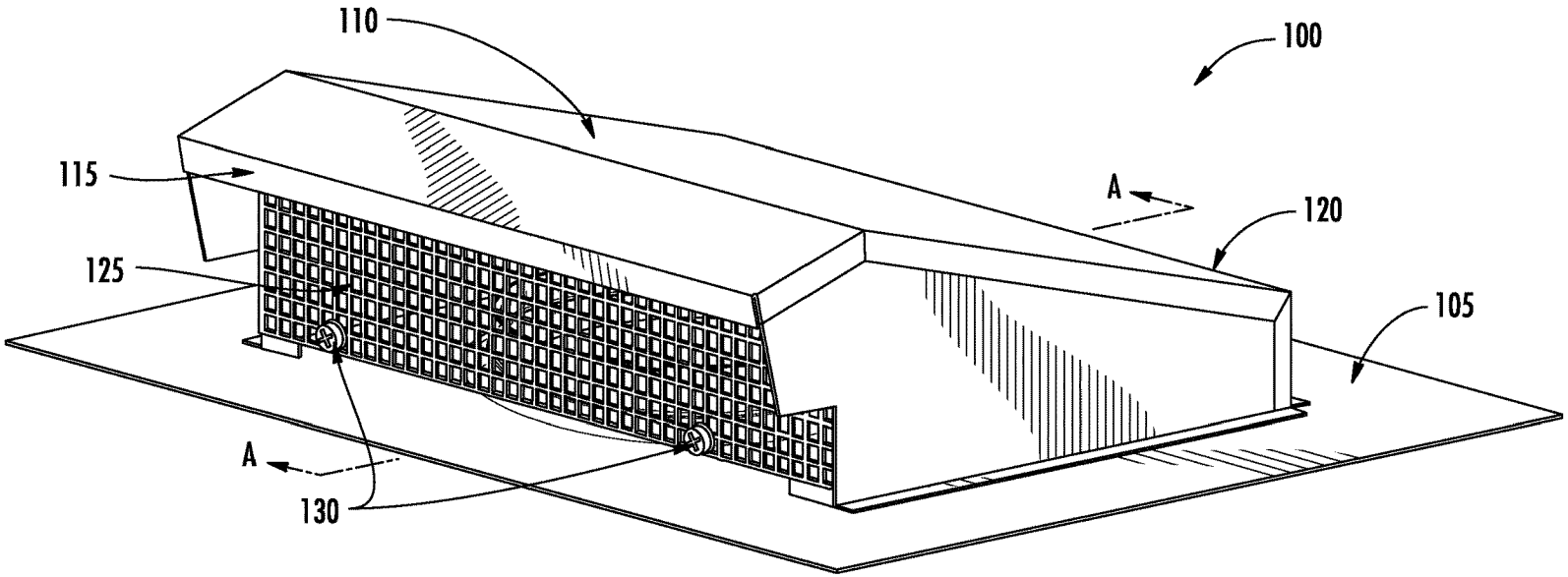
Figure 2:
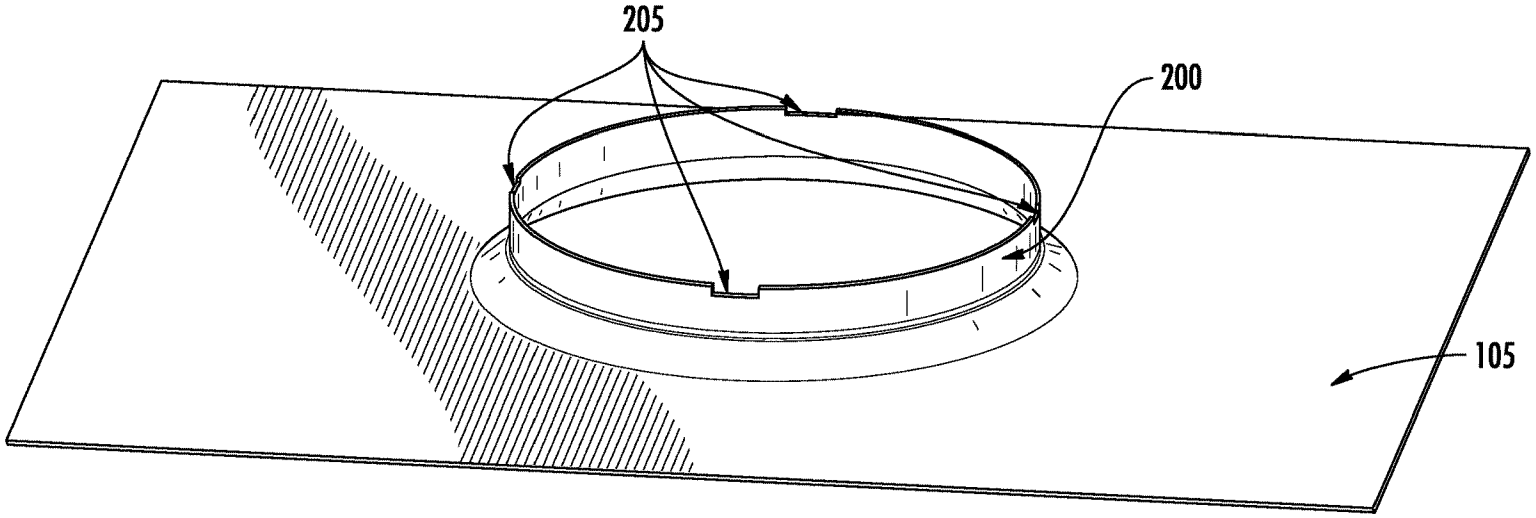
Figure 3:
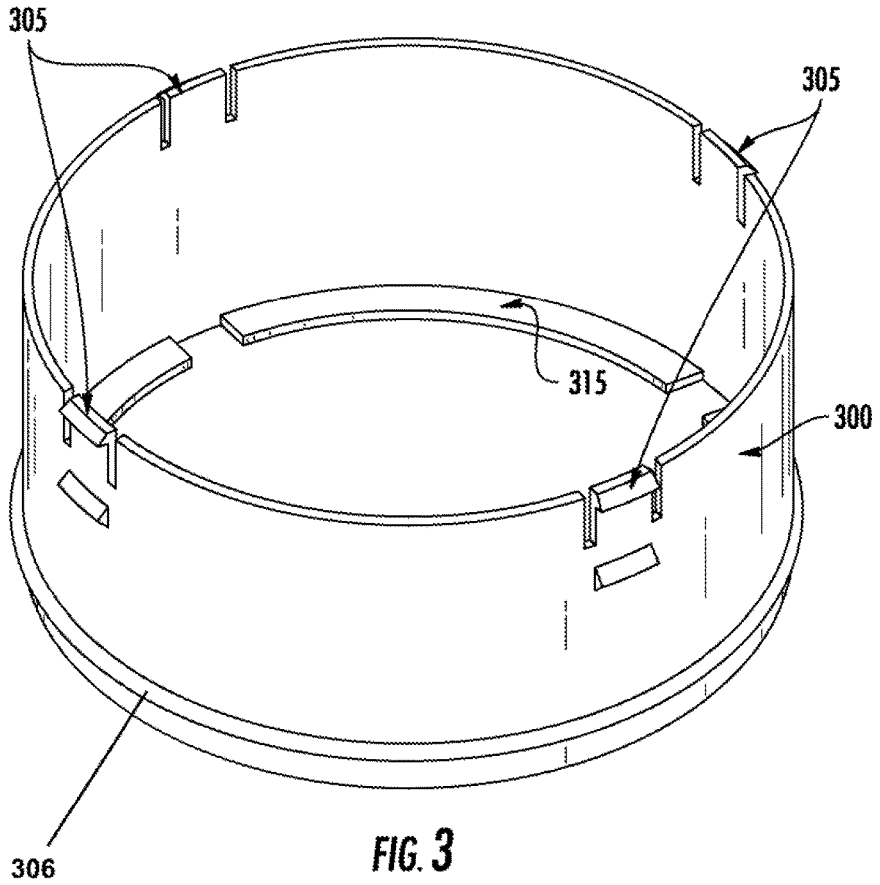
Figure 4:
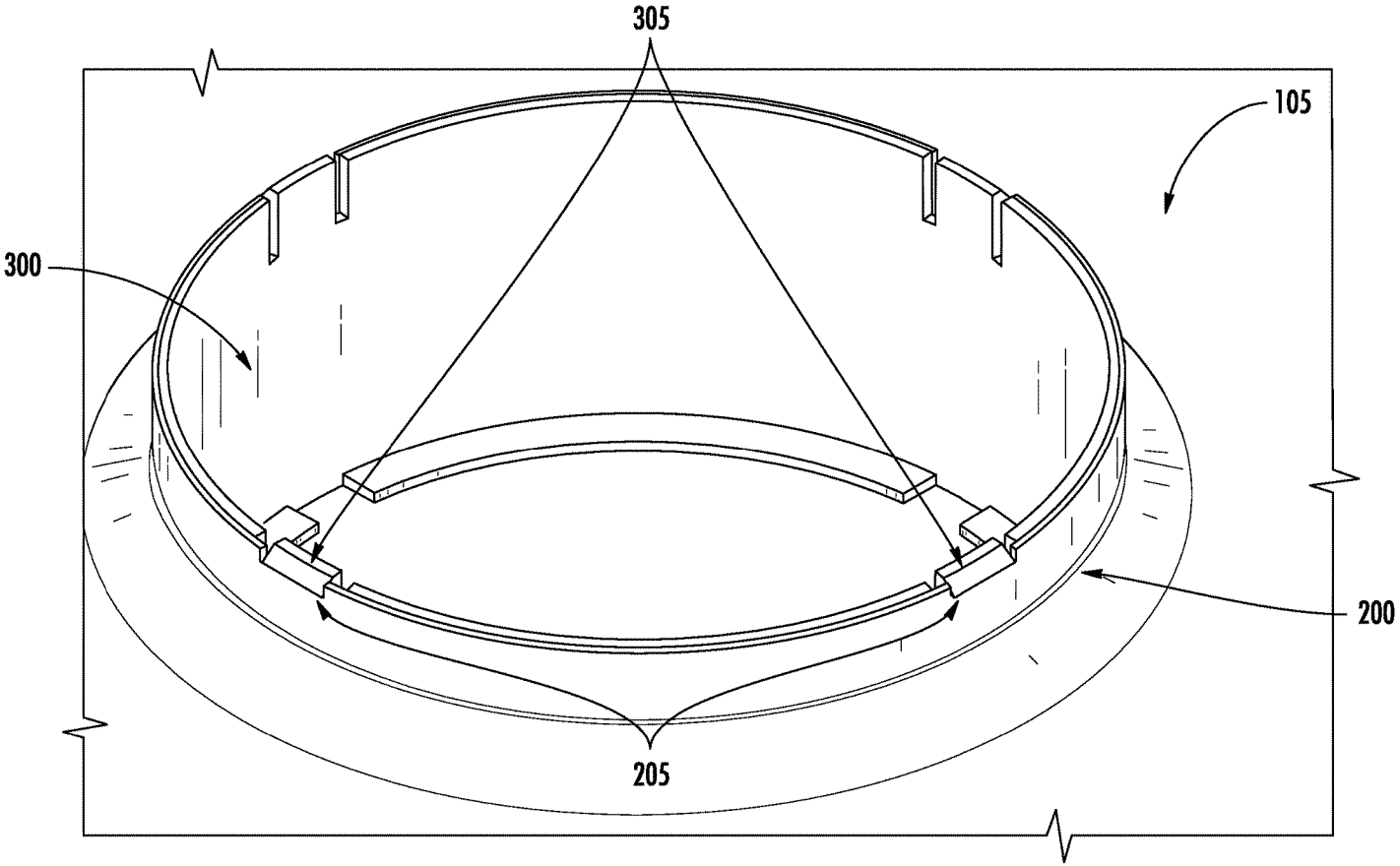
Figure 5:
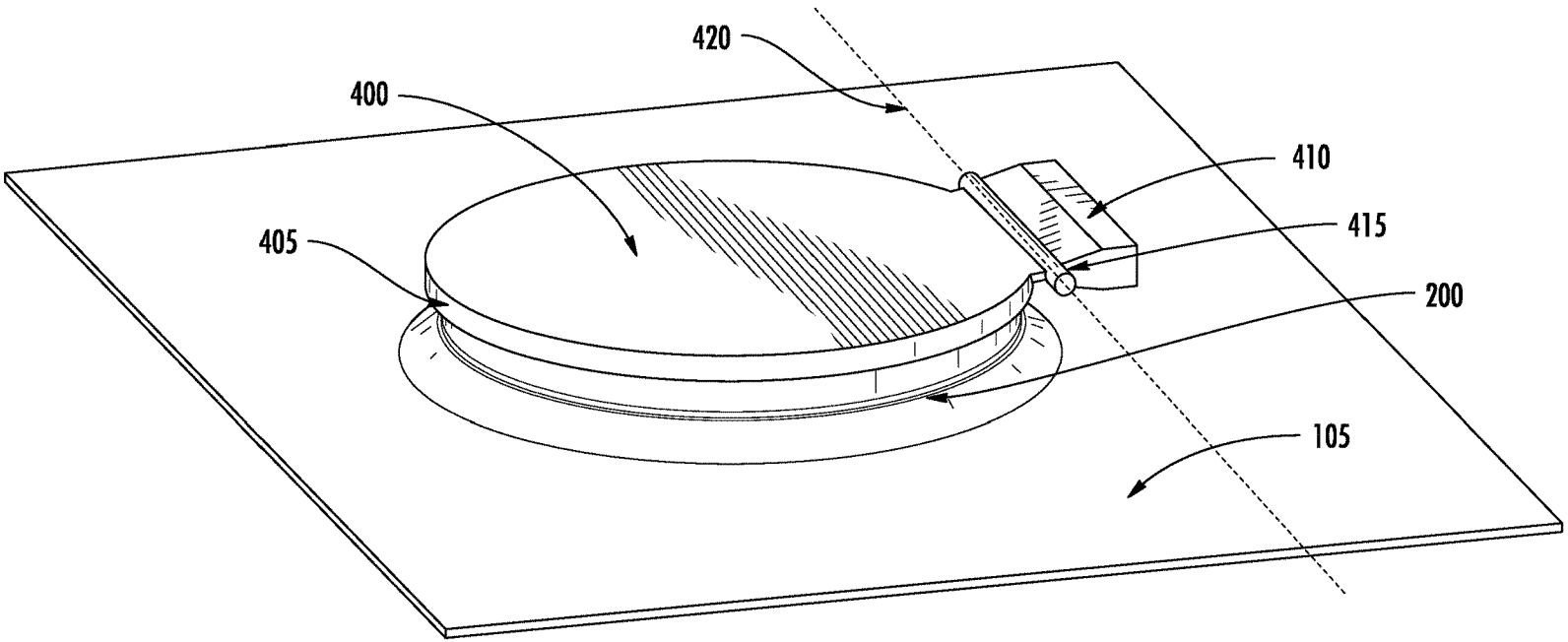
Figure 6:
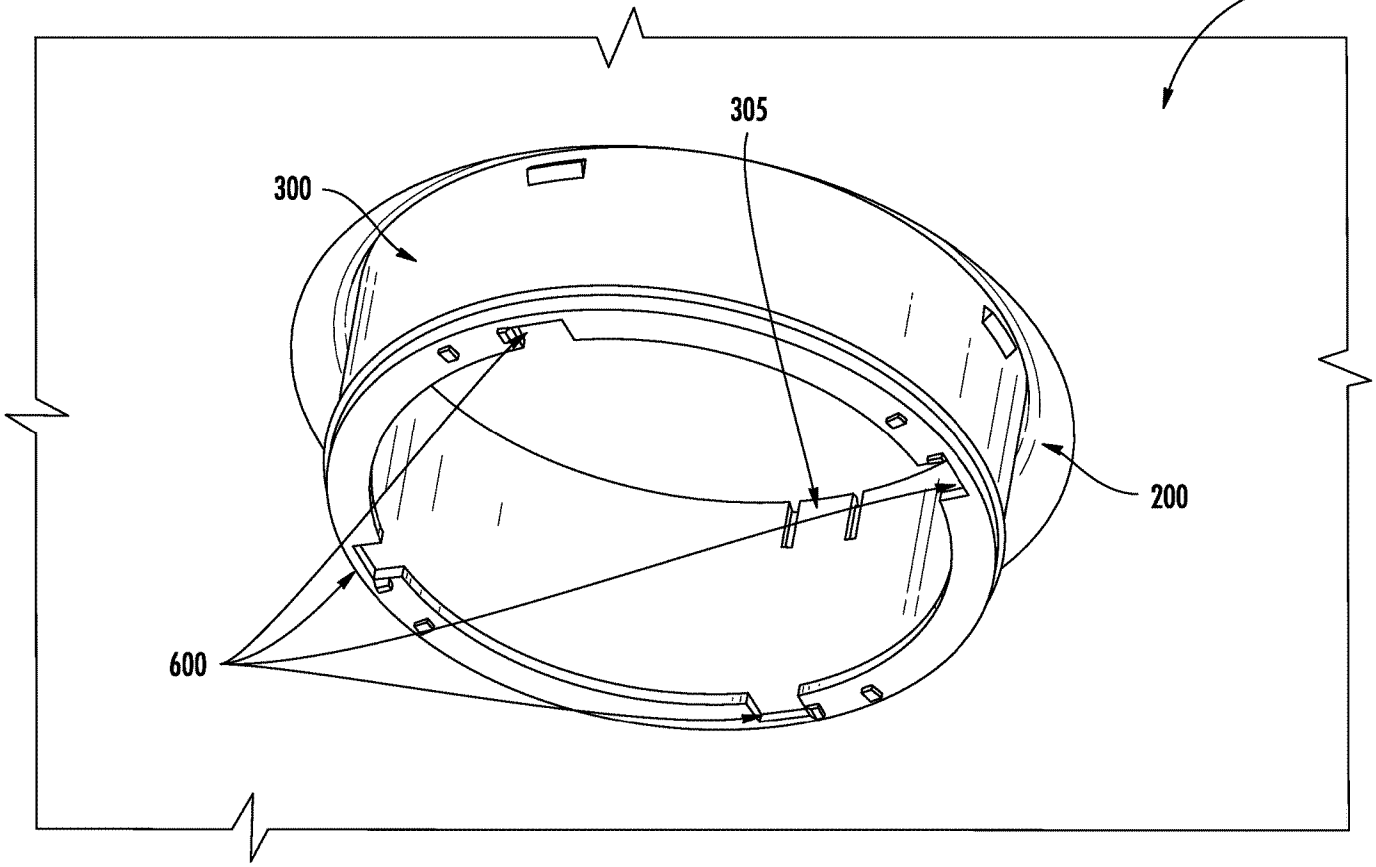
Figure 7:
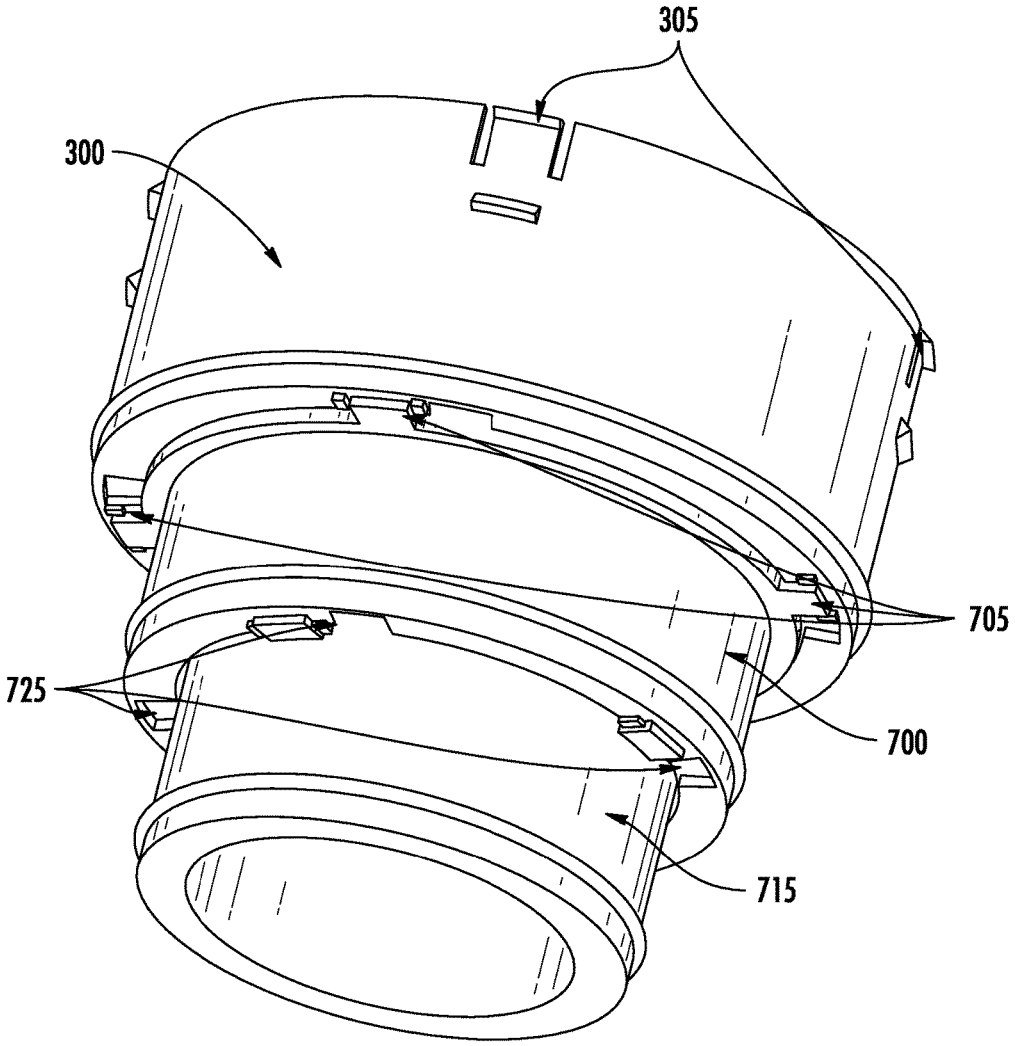
Figure 8:
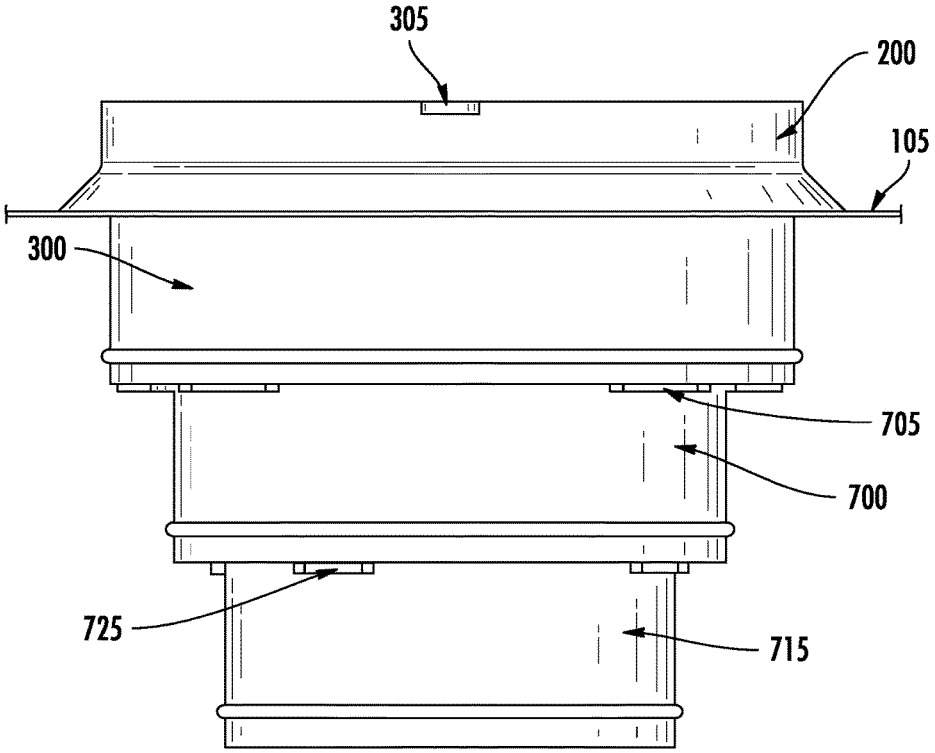
Figure 9:
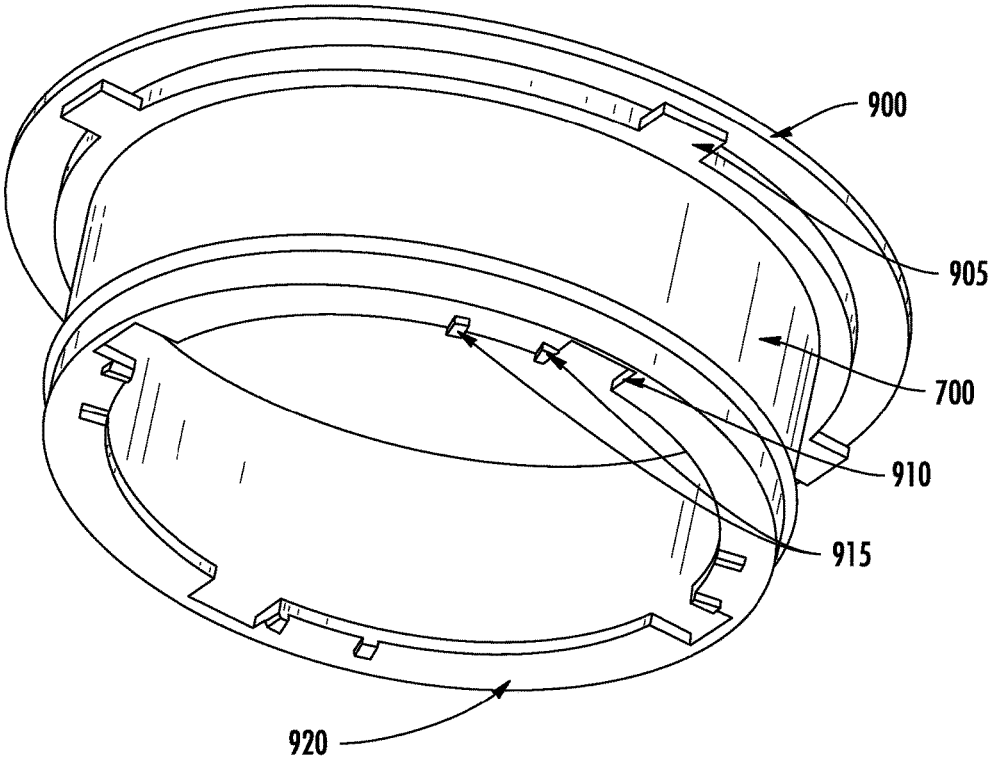
Figure 10:
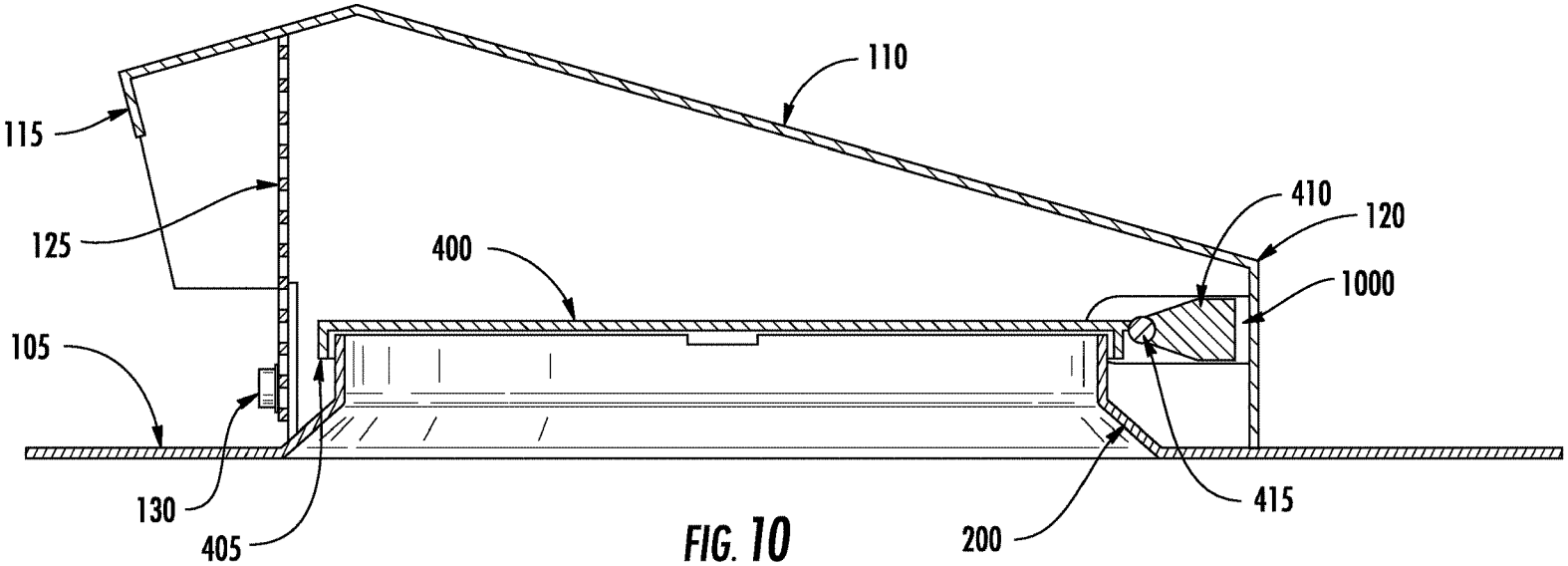

Having thus described the invention in general terms, reference will now be made to the accompanying drawings, which are not necessarily drawn to scale, and wherein:

FIG. 1 illustrates a perspective exterior view of an adaptive exhaust vent, in accordance with some embodiments discussed herein;

FIG. 2 illustrates a perspective view of a base member of FIG. 1, in accordance with some embodiments discussed herein;

FIG. 3 illustrates a perspective view of a removable vent adapter, in accordance with some embodiments discussed herein;

FIG. 4 illustrates a top perspective view of the removable vent adapter of FIG. 3 installed in a base member, in accordance with some embodiments discussed herein;

FIG. 5 illustrates a perspective view of a pivoting damper and base member, in accordance with some embodiments discussed herein;

FIG. 6 illustrates a bottom perspective view of the removable vent adapter of FIG. 3 installed in a base member, in accordance with some embodiments discussed herein;

FIG. 7 illustrates a perspective view of a separable removable vent adapter, in accordance with some embodiments discussed herein;

FIG. 8 illustrates a side view of a separable removable vent adapter of FIG. 7 installed in a base member, in accordance with some embodiments discussed herein;

FIG. 9 illustrates a bottom perspective view of a removable vent adapter of FIG. 8, in accordance with some embodiments discussed herein; and FIG. 10 illustrates, a cut away of an adaptive exhaust vent and separable removable vent adapter in accordance with some embodiments discussed herein.

DETAILED DESCRIPTION

Overview

Embodiments of the present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like reference numerals refer to like elements throughout.

In many structures, gases are generated in the interior of the structure from regular use of consumer appliances, like those often found in kitchens, as well as by steam generated in bathrooms (e.g. hot showers or the like). These gases are often vented to an exterior of the structure to allow for uniform pressure and temperature to be maintained within the structure. Often exhaust vents are used as a means for transferring these gases from the interior to the exterior of the structure; however, traditional exhaust vents fail to provide adaptability to accommodate varying sized connections found in structures, and fail to adequately prevent debris from entering the structure.

Embodiments of the present invention that are described hereinbelow provide an adaptive exhaust vent. In addition to kitchens and bathroom vent assemblies described herein, one of ordinary skill in the art will appreciate that the devices and methods discussed herein may be scaled to accommodate any structure or conduit.

Adaptive Exhaust Vent

With reference to FIG. 1, an exterior view of an adaptive exhaust vent 100 is shown with a base member 105, a housing 110, a first end 115, a second end 120, an exterior grate 125, and one or more securement elements 130. The housing 110 may be configured to abut the base member 105, and may be further configured to cover an opening defined by the base member 105, hereinafter described. In some embodiments, the housing 110 may be temporarily secured to the base member 105 (e.g., via screws, nails, adhesive, or the like) or may be permanently secured (e.g., via welding, machining from a single piece of material, or the like). In some embodiments, the housing 110 may be substantially hollow (e.g., a shell, covering, case, frame, etc.) and may further define an exterior opening. In such an embodiment, the exterior opening may be disposed on a first end 115 of the housing 110, and the housing may further define an end opposite the opening defined herein as a second end 120.

The housing 110 may be further defined to maintain fluid communication between an opening of the base member 105 (as seen in FIG. 2) and an exterior of the housing 110. By way of example, and further discussed below, the housing 110 may allow air to pass from the opening of the base member 105, through the housing 110, and to an exterior of the housing 110. In some embodiments, the housing 110 defining a first end 115 and a second end 120 may be configured to promote and/or facilitate fluid flow in a user-defined direction. As seen in FIG. 1, the first end 115 may define a first height associated with an exterior opening, while the second end 120 may define a second height associated with an end opposite the exterior opening. In such an embodiment, the first height may be larger than the second height. As would be appreciated by one of ordinary skill in the art in light of the present disclosure, as air enters the housing via an opening disposed in the base member 105, the housing 110 may direct the air to an exterior of the housing.

For the sake of clarity and convenience of description, the embodiments that are described herein are made in reference to various components, elements, members, or the like that allow and/or maintain fluid communication. As used herein, the term "fluid" may refer to a substance, such as a gas.

With continued reference to FIG. 1, in some embodiments, an exterior grate 125 may be positioned over the exterior opening defined on a first end 115 of the housing 110. This exterior grate 125 may be secured or attached to the housing 110 via one or more securement elements 130 (e.g., screws, nails, adhesives, or the like). The exterior grate 125 may be configured to prevent or discourage particles (e.g., leaves, branches, twigs, trash, or the like) from entering the housing 110. In some embodiments, the exterior grate 125 may be removable such that particles which may have entered the housing 110 may be removed by a user. The present disclosure contemplates that the exterior grate 125 may be a mesh, frame of bars, or any similar configuration which allows air to pass through while inhibiting entry of larger particles.

With reference to FIG. 2, a base member 105 is shown with a raised flange 200 and one or more recesses 205. As can be seen in FIG. 2, the base member may be configured such that the raised flange 200 defines an opening. In some embodiments, the raised flange 200 may define a circular opening disposed radially inward of the raised flange 200. The base member 105 may be configured to be secured to a structure (e.g., office, apartment, house, or building of any kind) and further configured such that the opening defined by the raised flange 200 may be in fluid communication with an exhaust conduit of the structure. Additionally, the present disclosure contemplates that the structure to which the adaptive exhaust vent 100 is attached may define any number of exhaust conduits (e.g., pipes, tubes, ducts, channels, flumes, gutter, or the like), with any number of cross-sections (e.g., circle, square, triangle, rhombus, or any polygon) through which a fluid may travel. The present disclosure further contemplates that the base member 105 may be secured to a structure (e.g., to a wall, roof, or the like) via any known connections or attachment means (e.g., screws, nails, adhesives, or the like).

In some embodiments, the base member 105 may be configured to directly attach to an exhaust conduit of a structure. In such an embodiment, the base member 100, via the opening defined by the raised flange 200, may be configure to encircle an end of the exhaust conduit of the structure. In other embodiments, the base member 105 may be formed as an integral part of the structure to which the adaptive exhaust vent 100 is installed. By way of example, the base member 105 may be formed as part of the roof structure such that the housing 110 may attach to the structure, via the base member 105, as discussed above.

With continued reference to FIG. 2, the base member 105 may further define one or more recesses 205 disposed on the raised flange 200. These one or more recesses 205 may be configured to receive a removable vent adapter (e.g., removable vent adapter 300 in FIG. 3). Although illustrated in FIG. 2 as recesses, the present disclosure contemplates that any attachment means (e.g., male to female connections, bayonet connections, snaps, or the like) may be utilized by the adaptive exhaust vent 100 in order for the base member 105 to receive a removable vent adapter.

With reference to FIG. 3, a removable vent adapter 300 is illustrated with one or more deflectable tabs 305. As can be seen in FIG. 3, one or more deflectable tabs 305 are defined by the removable vent adapter 300 and may be configured to connect the removable vent adapter 300 to the base member 105. With reference to FIG. 4, the one or more deflectable tabs 305 may be configured to engage the one or more recesses defined by the raised flange 200 of the base member 105 such that the removable vent adapter 300 is attached radially inward of the base member 105. Although illustrated as tabs 305 in FIGS. 3-4, the present disclosure contemplates that any attachment means (e.g., male to female connections, bayonet connections, snaps, or the like) may be utilized by the removable vent adapter 300 to engage a corresponding element (e.g., recesses 205 in FIG. 4).

With reference to FIGS. 3-4, the removable vent adapter 300 may further be configured to connect the raised flange 200 defined by the base member 105 to an exhaust conduit of the structure to which the adaptive exhaust vent 100 is installed. The removable vent adapter 300 may also be configured to maintain fluid communication between the opening, defined by the raised flange 200, and the exhaust conduit. By way of example, the removable vent adapter 300 may be connected to the base member 105 by the one or more deflectable tabs 305 engaging corresponding recesses 205 defined by the raised flange 200. The removable vent adapter 300 may then be connected to an exhaust conduit of a structure by inserting at least a portion of the removable vent adapter 300 within a portion of the exhaust conduit. Specifically, a removable vent adapter 300 with a circular cross-section may be inserted into a corresponding exhaust conduit also having a circular cross-section such that the radially outward surface of the removable vent adapter 300 at least partially contacts the radially inward surface defined by the exhaust conduit.

With reference to FIG. 3, the removable vent adapter 300 may, in some embodiments, further define one or more sealing elements. As discussed above, when the removable vent adapter 300 is inserted or otherwise connected to an exhaust conduit of a structure, the removable vent adapter 300 may be configured to maintain fluid communication between the base member 105 (e.g., opening defined by raised flange 200) and the exhaust conduit. To facilitate maintaining fluid communication, the removable vent adapter 300 may further comprise a sealing element 306 (e.g., seal, bead, lip, rim, gasket, or the like) such that the sealing element may contact a surface of the exhaust conduit and substantially seal the exhaust conduit. Although described in reference to a bead disposed on the exterior surface of the removable vent adapter 300, the present disclosure also contemplates that a sealing element may be disposed on an inner surface of the removable vent adapter 300. By way of example, in an embodiment in which the exhaust conduit of a structure has an outer diameter smaller than the inner diameter of the removable vent adapter 300, at least a portion of the exhaust conduit may be inserted within a portion of the vent adapter 300, such that the sealing element may be disposed on an inner surface of the vent adapter 300 and configured to contact the outer surface of the exhaust conduit.

With reference to FIG. 5, a pivoting damper 400 is illustrated resting atop the raised flange 200 and corresponding opening of the base member 105. The pivoting damper 400 may be configured to rest atop the opening of the base member 105 or the raised flange 200. The pivoting damper 400 may further comprise a rim 405 configured to, when in a closed position, encircle the raised flange 200. The rim 405 may be defined by the pivoting damper 400 as a flange, lip, or any other protrusion or extension such that at least a portion of the rim 405 is configured to prevent entry of objects into the opening defined by the raised flange 200, when in a closed position. By way of specific example, the pivoting damper 400 may rest atop the raised flange 200 and the rim 405 may extend in perpendicular to the pivoting damper 400 such that the pivoting damper 400 and rim 405 partially envelope and enclose the raised flange 200. Although the rim 405 is described as extending perpendicular to the pivoting damper 400, the present disclosure contemplates that the rim 405 may be disposed in any plane or at any angle relative to the pivoting damper 400. By way of a more particular example, the rim 405 may be configured to extend at an obtuse angle from the pivoting damper 400 such that fluid adjacent the pivoting damper 400 may be urged away from the opening defined by the raised flange 200.

With continued reference to FIG. 5, in some embodiments, the pivoting damper 400 may be pivotally connected to a side of the housing (e.g., housing 110 in FIG. 1). In some embodiments, this connection may be via a pivot rod 415 connected to one or more brackets attached to at least on side of the housing 110 (e.g., bracket 1000 in FIG. 9). The pivoting damper 400 may pivot about an axis 420 such that in an open position, a gas may flow between an exhaust conduit (e.g., connected to the base member 105 via the removable adapter 300) and the housing 110. Although described herein as a pivoting connection, the present disclosure contemplates that the damper 400 may move between an open or closed position via slider, rotating joints, hinges, or the like.

In some embodiments, the pivoting damper 400 may further comprise a counterbalance 410 configured to counterbalance the damper 400. This counterbalance 410 may be configured to allow the pivoting damper 400 to open to an open position while exhaust pressure is applied to the damper and to urge the pivoting damper 400 to a closed position when exhaust pressure is removed. The counterbalance 410 may be disposed proximate a fixed end (e.g., connected to the pivot rod 415) of the pivotal damper 400. By way of example, when gas is venting from the exhaust conduit through the base member 105, the counterbalance 410 may be configured such that the force of the air raises the damper 400 to at least a partially open position. Once the force of the air is less than the force required to open the pivotal damper 400 (e.g., when no air is vented by the exhaust conduit of the structure), the pivotal damper 400 may return to a closed position. As is evident by this example, the default position (e.g., when no air is vented by the adaptive exhaust vent) of the pivotal damper 400 may be a closed position as shown in FIG. 5. Additionally, the present disclosure contemplates that the weight of the counterbalance (e.g., or equivalent force exhibited by the counterbalance) may be configured to any necessary weight to balance the pivotal damper 400 between open and closed positions. Although illustrated in FIG. 5 as a weighted counterbalance, the present disclosure contemplates any means for balancing the pivotal damper 410 between open and closed positions (e.g., via a spring, linkage, weight of the damper, dampening force in pivot rod, or the like).

With reference to FIGS. 6-8, in some embodiments, the removable vent adapter may be comprised of two or more separable components, which, in some embodiments, may be tiered and have successively smaller outer diameters. In FIG. 6, a perspective view of the bottom side of a removable vent adapter 300 connected to a base member 105 is illustrated. As seen in FIG. 6, in some embodiments, the removable vent adapter 300 (e.g., a first separable component) may be configured to attach to a second separable component (e.g., second separable component 700 in FIG. 7). In such an embodiment, the removable vent adapter 300 may define one or more connections 600 such that the removable vent adapter 300 may engage a corresponding second separable component. In some embodiments, the removable vent adapter 300 may be configured to engage a 6" diameter exhaust conduit.

With reference to FIG. 7, the removable vent adapter 300 is illustrated connected to a second separable component 700 and the second separable component 700 connected to a third separable component 715. The second separable component 700 may define one or more connections 705 configured to engage the one or more connections 600 of the removable vent adapter 300 (e.g., first separable component). In some embodiments, the second separable component 700 may have a smaller outer diameter than the outer diameter of the removable vent adapter 300. By way of example, the second separable component 700 may be configured to engage a 4" diameter exhaust conduit, while the removable vent adapter 300 may be configured to engage a larger 6" diameter exhaust conduit. In such an embodiment where the removable vent adapter 300 is connected to a second separable component 700 (e.g., the adaptive exhaust vent 100 comprising two separable components), the second separable component 700 may be configured to connect to an exhaust conduit of a structure.

As discussed above, when the second separable component 700 is inserted or otherwise connected to an exhaust conduit of a structure, the second separable component 700 may be configured to maintain fluid communication between the base member 105 (e.g., opening defined by raised flange 200) and the exhaust conduit. To facilitate maintaining fluid communication, the second separable component 700 may, in some embodiments, further comprise a sealing element (e.g., seal, bead, lip, rim, gasket, or the like) such that the sealing element may contact a surface of the exhaust conduit and substantially seal the exhaust conduit. Although described in reference to a bead disposed on the exterior surface of the second separable component 700, the present disclosure also contemplates that a sealing element may be disposed on an inner surface of the second separable component 700. By way of example, in an embodiment in which the exhaust conduit of a structure has an outer diameter smaller than the inner diameter of the second separable component 700, the sealing element may be disposed on an inner surface of the second separable component 700 and configured to contact the outer surface of the exhaust conduit.

With continued reference to FIG. 7, the second separable component 700 may be connected to a third separable component 715. The third separable component 715 may define one or more connections 725 configured to engage corresponding connections defined by the second separable component 700. In some embodiments, the third separable component 715 may have a smaller outer diameter than the outer diameter of the second separable component 700. By way of example, the third separable component 715 may be configured to engage a 3" diameter exhaust conduit. In such an embodiment where the removable vent adapter 300 is connected to a second separable component 700 and the second separable component 700 is connected to a third separable component 715 (e.g., the adaptive exhaust vent 100 comprising three separable components), the third separable component 715 may be configured to connect to an exhaust conduit of a structure.

As discussed above, when the third separable component 715 is inserted or otherwise connected to an exhaust conduit of a structure, the third separable component 715 may be configured to maintain fluid communication between the base member 105 (e.g., opening defined by raised flange 200) and the exhaust conduit. To facilitate maintaining fluid communication, the third separable component 715 may further comprise a sealing element (e.g., seal, bead, lip, rim, gasket, or the like) such that the sealing element may contact a surface of the exhaust conduit and substantially seal the exhaust conduit. Although described in reference to a bead disposed on the exterior surface of the third separable component 715, the present disclosure also contemplates that the sealing element may be disposed on an inner surface of the third separable component 715. By way of example, in an embodiment in which the exhaust conduit of a structure has an outer diameter smaller than the inner diameter of the third separable component 715, the sealing element may be disposed on an inner surface of the third separable component 715 and configured to contact the outer surface of the exhaust conduit.

With reference to FIG. 8, a side view of an embodiment comprised of three separable components of a removable vent adapter is illustrated connected with the base member 105. As can be seen in FIG. 8, the separable components may each connect one to another with the separable component having the largest outer diameter being connected to the base member 105. Although illustrated with only 3 separable components in FIGS. 7-8, the present disclosure contemplates that that the removable vent adapter (e.g., removable vent adapter 300 in FIG. 3) may comprise any number of separable components and may further be configured to connect to exhaust conduits of any diameter.

In some embodiments, the connections between each separable component (e.g., connections 600, 705, and/or 725) may comprises a bayonet type connection. In such an embodiment, the connections between each separable component may be such that one separable component defines a flange (e.g., male connector) with the other separable component defines a corresponding slot (e.g., female connector). By way of example, the third separable component 715 may define a flange configured to engage a corresponding slot defined by the second separable component 700 at the bayonet connection 725. The flange of the third separable component 715 may enter the slot of the second separable component 700 and, upon rotating of the third separable component 720, may enter a locked position. By rotating the third separable component 715 in the opposite direction, the flange may enter an unlocked position, and may allow the third separable component 715 to be detached. In some embodiments, the slot may further define a spring configured to urge the flange of the bayonet connection to a locked position.

With reference to FIG. 9, in some embodiments, one or more of the separable components (e.g., second separable component 700 and third separable component 715) may define an extension 900, a lip 905, a slot 910, and one or more securing tabs 915. In some embodiments, the connection between each separable component may be such that a smaller diameter separable component is inserted (e.g., dropped) into a larger diameter separable component. By way of example, the second separable component 700 may be configured to be inserted in the first separable component (e.g., removable vent adapter 300 in FIG. 8) such that the extension 900 of the second separable component 700 rests upon a bottom ridge of the first separable component (e.g., bottom ridge 315 in FIG. 3). In such an embodiment, the extension 900 may be configured to restrict the movement of the second separable component 700 such that the second separable component 700 does not extend beyond a desired distance into an exhaust conduit to which the embodiment is installed.

In some embodiments, the second separable component 700 may further define a lip 905 configured to be inserted into a slot (e.g., the one or more connections 600 in FIG. 6) of another separable component connecting to the second separable component 700. As is evident in FIG. 9, with reference to the second separable component 700, a slot 910 may be configured to receive a corresponding lip (e.g., similar to lip 905) of another separable component such that a corresponding extension of another separable component (e.g., third separable component 715) rests upon the bottom ridge 920 of the second separable component 700. By way of example, the second separable component 700 may be configured to receive the third separable component 715 by the third separable component 715 being inserted into the second separable component 700 such that the lip (e.g., similar to lip 905) of the third separable component 715 enters the slot 910.

With continued reference to FIG. 9, the separable components may further define one or more securing tabs 915. In some embodiments, following insertion of a lip into a corresponding slot, the separable component may be rotated to secure (i.e., lock in place or otherwise prevent movement thereof) the separable component. By way of example, once the third separable component 715 is inserted into the second separable component 700 and the lip of the third separable component 715 enters the slot 910, as described above, the third separable component 715 may be rotated such that the lip (e.g. similar to lip 905) rests between two securing tabs 915. In some embodiments, the one or more securing tabs 915 may define inclines (e.g., ramp, slope, gradient, or the like) such that when the separable component is rotated, the lip may translate across a securing tab in one direction, but may be restricted from translating in the opposite direction when the separable component is rotated in the opposite direction. In some embodiments, the bottom rim 920 may define one or more walls disposed on one edge of the slot 910 such that the separable component may only be rotated in one direction (e.g., clockwise).

As shown in FIG. 9, the present disclosure contemplates that four lips 905, slots 910, and sets of securing tabs 915 may be equally spaced and disposed circumferentially on the separable component. However, although illustrated with four equally spaced lips, slots, and securing tab sets, the present disclosure contemplates that any number of lips, slots, and securing tabs may be used in the attachment between separable components of the removable vent adapter. Further, the present disclosure contemplates that any lips, slots, and securing tabs, and combination thereof, may be disposed at any location on the separable component so long as connection between separable components may be achieved.

In some alternative embodiments, each separable component may be defined to connect to one another via a snapping connection. By way of example, the bottom rim 920 of the second separable component may be dimensioned such that the third separable component may partially be inserted into the second separable component and snap into a locked position. Such a snapping connection may also restrict movement of connected separable components.

With reference to FIG. 10, a cross-section view of the adaptive exhaust vent 100 embodiment is illustrated. As can be seen in FIG. 9, the adaptive exhaust vent 100 may be configured such that a base member 105 is configured to be secured to a structure and configured to be in fluid communication with an exhaust conduit of the structure via an opening defined by a raised flange 200. The adaptive exhaust vent may comprise a removable vent adapter 300, connected to the raised flange 200 and configured to maintain fluid communication between the opening (defined by the raised flange 200) and the exhaust conduit. The adaptive roof vent may comprise a substantially hollow housing 110 attached to the base member 105 and configured to cover the opening defined by the raised flange 200 and maintain fluid communication between the opening and an exterior of the housing. The housing 110 may define a first end 110 and a second end 120 wherein the housing 110 is configured to facilitate the flow of air in a desired direction. In some embodiments, a pivoting damper 400 may rest atop of the opening defined by the raised flange 200 and may further define a rim 405 configured to at least partially encircle the raised flange 200. The pivoting damper 400 may define a counterbalance configured to counterbalance the pivoting damper between open and closed positions. The pivoting damper 400 may pivot about a pivot rod 415 which may be connected to the housing 110 via the bracket 1000.

The present disclosure contemplates that the present invention may be created from any suitable material known in the art (e.g., aluminum, steel, copper, plastic, or the like). Additionally, due to the installation of exhaust vents on the exterior of structures, the present disclosure contemplates that the present invention may be comprised of any material suitable to withstand varying weather conditions (e.g., snow, rain, hail, or the like). Although the present invention is depicted as various members (e.g., a base member, a housing, etc.), the present disclosure contemplates that the present invention may be comprised of any number of individual members or pieces so long as continuous fluid communication is provided between the interior of a structure and an exterior of the exhaust vent.

Many modifications and other embodiments of the inventions set forth herein will come to mind to one skilled in the art to which these inventions pertain having the benefit of the teachings presented in the foregoing descriptions and the associated drawings. Although the figures only show certain components of the apparatus and associated systems and methods described herein, it is understood that various other components may also be part of the adaptive exhaust vent. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An exhaust vent comprising:

a base member configured to be secured to a structure having an exhaust conduit, the base member defining: an opening, wherein the opening is in fluid communication with the exhaust conduit of the structure; and a raised flange disposed around the opening;

a removable vent adapter, wherein the adapter is configured to connect to the raised flange and maintain fluid communication between the opening and the exhaust conduit;

a substantially hollow housing attached to the base member, the housing configured to:

cover the opening of the base member; and maintain fluid communication between the opening and an exterior of the housing; and a pivoting damper disposed within the substantially hollow housing, wherein the damper is configured to rest atop the opening of the base member when in a closed position, wherein the pivoting damper further defines a counterbalance configured to counterbalance the pivoting damper between open and closed positions, wherein a thickness of the counterbalance in an airflow direction is greater than a thickness of the pivoting damper in the airflow direction, and wherein the pivoting damper is connected to a side of the housing via a bracket.

2. The exhaust vent according to claim 1, wherein the removable vent adapter comprises two or more separable airflow guidance components.

3. The exhaust vent according to claim 1, wherein the pivoting damper is pivotally connected to a side of the housing opposite the opening.

4. The exhaust vent according to claim 1, wherein the pivoting damper further defines a rim configured to, in a closed position, encircle the raised flange of the base member.

5. The exhaust vent according to claim 1, wherein the substantially hollow housing further defines an exterior opening.

6. The exhaust vent according to claim 5, further defining a grate configured to cover the exterior opening.

7. The exhaust vent according to claim 5, wherein the substantially hollow housing further defines a first height associated with a side of the housing defining the exterior opening, and a second height associated with a side opposite the exterior opening, wherein the first height is larger than the second height to promote fluid flow in a defined direction.

8. The exhaust vent according to claim 1, wherein the raised flange further defines one or more recesses configured to receive the removable vent adapter.

9. The exhaust vent according to claim 8, wherein the removable vent adapter further defines one or more deflectable tabs configured to engage the one or more recesses of the raised flange.

10. The exhaust vent according to claim 1, wherein the removable vent adapter further defines a sealing element configured to substantially seal the exhaust conduit of the structure.

11. The exhaust vent according to claim 2, wherein the removable vent adapter comprises two separable airflow guidance components, and wherein the separable airflow guidance components are tiered such that a first separable airflow guidance component has a larger outer diameter than a second separable airflow guidance component.

12. The exhaust vent according to claim 11, wherein the removable vent adapter further comprises a third separable airflow guidance component.

13. The exhaust vent according to claim 12, wherein the separable airflow guidance components are tiered such that the second separable airflow guidance component has a larger outer diameter than the third separable airflow guidance component.

14. The exhaust vent according to claim 11, wherein the first separable airflow guidance component is connected to the raised flange.

15. The exhaust vent according to claim 11, wherein the exhaust conduit is connected to the second separable airflow guidance component.

16. The exhaust vent according to claim 12, wherein the exhaust conduit is connected to the third separable airflow guidance component.

17. The exhaust vent according to claim 12, wherein the separable airflow guidance components connect to one another via a bayonet-type connection.

18. The exhaust vent according to claim 11, wherein the first airflow guidance component and the second airflow guidance component each further comprise a sealing element configured to substantially seal the exhaust conduit of the structure.

19. The exhaust vent according to claim 12, wherein each of the first separable airflow guidance component, the second separable airflow guidance component, and third separable airflow guidance component further comprises a sealing element configured to substantially seal the exhaust conduit of the structure.

20. An exhaust vent comprising:

a base member configured to be secured to a structure having an exhaust conduit, the base member defining:

an opening, wherein the opening is in fluid communication with the exhaust conduit of the structure; and a raised flange disposed around the opening;

a removable vent adapter, wherein the adapter is configured to connect to the raised flange and maintain fluid communication between the opening and the exhaust conduit;

a substantially hollow housing attached to the base member, the housing configured to:

cover the opening of the base member; and maintain fluid communication between the opening and an exterior of the housing; and a pivoting damper disposed within the substantially hollow housing, wherein the damper is configured to rest atop the opening of the base member when in a closed position, wherein the raised flange of the base member includes one or more open-ended recesses, wherein the pivoting damper further comprises a rim configured to, in a closed position, encircle the raised flange of the base member, and wherein, in a closed position, the rim extends below the bottom edge of the one or more recesses.

* * * * *